US007036897B2

(12) United States Patent
Gaston et al.

(10) Patent No.: US 7,036,897 B2
(45) Date of Patent: May 2, 2006

(54) METHOD AND APPARATUS FOR OPERATING A PRINTER

(75) Inventors: Gonzalo Gaston, Barcelona (ES); Ramon Vega, Sabadell (ES); Jose Luis Valero, Sant Cugat del Valles (ES)

(73) Assignee: Hewlett-Packard Company, L.P., Houston, TX (US)

( * ) Notice: Subject to any disclaimer, the term of this patent is extended or adjusted under 35 U.S.C. 154(b) by 214 days.

(21) Appl. No.: 10/697,313

(22) Filed: Oct. 31, 2003

(65) Prior Publication Data

US 2005/0093914 A1 May 5, 2005

(51) Int. Cl.
*B41J 29/38* (2006.01)
*B41J 2/165* (2006.01)

(52) U.S. Cl. ..... 347/9; 347/23

(58) Field of Classification Search ..... 347/3, 347/9, 13–15, 22, 23, 28–30, 33, 35, 41, 347/42, 54, 57; 358/3.01, 3.06, 3.12
See application file for complete search history.

(56) References Cited

U.S. PATENT DOCUMENTS 5,170,261 A * 12/1992 Cargill et al. ..... 358/3.12
6,834,926 B1 * 12/2004 Shibata ..... 347/15
6,871,934 B1 * 3/2005 Masuyama et al. ..... 347/23

* cited by examiner

*Primary Examiner*—Shih-Wen Hsieh
(74) *Attorney, Agent, or Firm*—Foley & Lardner LLP

(57) ABSTRACT

An incremental printer comprising a plurality of printing elements arranged to print different portions of an image, the printer being arranged, prior to printing an image, to identify elements that are not required for printing the image and to implement an element servicing routine, the printer being arranged to exclude one or more of the identified elements from the servicing routine.

17 Claims, 3 Drawing Sheets

METHOD AND APPARATUS FOR OPERATING A PRINTER

FIELD OF THE INVENTION

This invention relates to printers. In particular, but not exclusively, it relates to method of operating a printer of the kind comprising a print head having an array of dot printing elements extending in a first direction relative to a page to be printed and which prints at least a part of the page during relative movement between the print head and page in a second direction at an angle to the first direction. The invention is particularly, but not exclusively, suitable for the type of printers known as inkjet printers.

CROSS REFERENCE TO RELATED APPLICATIONS

This application is related to the following patent application: U.S. patent application Ser. No. 10/697,010 filed Oct. 31, 2003, also entitled "Method and Apparatus of Operating a Printer", in the name of Hewlett-Packard.

BACKGROUND OF THE INVENTION

Inkjet printers print dots (pixels) by ejecting very small drops of ink onto a print medium (herein generically referred to as "paper"). They often include a movable carriage that supports one or more print heads each having ink ejecting nozzles. The carriage repeatedly passes over the surface of the paper, which is moved incrementally relative to the carriage between passes, and the nozzles are selectively "fired" to eject drops of ink at appropriate times pursuant to commands of a microcomputer or other print controller, the timing of the application of the ink drops corresponding to the pattern of pixels of the image being printed.

There are also so-called page-high (or page-wide, depending on the page orientation) inkjet printers in which the print head is in the form of a printbar extending the full height (or width) of a page to be printed. In this case the printbar has an array of ink ejecting nozzles along substantially its full length, so that an entire page is printed during a single pass of the printbar relative to the page. Again, a print controller determines which nozzles fire and when as the printbar passes over the page. In some cases the printbar moves across the stationary paper; in others, the printbar is stationary and the paper passes below it. These printers are especially useful for the fast printing of monochrome (e.g. black) text, and are used in, for example, monochrome copiers. Other inkjet printers use a printbar which, although not extending the full height or width of a page, extend a substantial part thereof, so that a complete page is printed only after a small number of passes, say two or three.

In inkjet printers, especially those with a large number of nozzles such as page-wide and other printbar printers, the need to eject a number of drops per nozzle, typically of the order of hundreds of firing cycles, in order to "wake up" the nozzle before starting a print job results in a lot of ink wastage compared to the ink used to actually print. This wastage is worse as print jobs are shorter and more spaced in time, and is especially high in text copying, which has a very low print density.

Prior solutions are limited to determining a minimum value of wake-up firing that is applied to all nozzles in a print head.

SUMMARY OF THE INVENTION

Accordingly, the present invention provides a method of operating a printer of the kind comprising a print head having an array of dot printing elements extending in a first direction relative to a page to be printed and which prints at least a part of the page during relative movement between the print head and page in a second direction at an angle to the first direction, the method comprising performing the following steps:

(A) prior to a print job:

(a) identifying portions of the array of printing elements which will be needed at least for a first pass of the print head relative to the first page of the print job, and (b) servicing printing elements according to the array portions identified in step (a) so that one or more printing elements outside the identified array portions are not serviced, and (B) printing the at least first pass.

In a preferred embodiment of the invention each array portion identified in step (a) comprises at least one group capable of printing a respective row of halftone values at a given resolution on the page with redundancy among the elements of the group.

In such embodiment step (b) preferably comprises:

(b1) for at least some of the groups, reducing the number of elements in the group available for use, and (b2) servicing only the printing elements remaining available for use after step (b1).

Although primarily applicable to inkjet printers, the invention is applicable to any printer where individual printing elements need to be brought into a serviceable condition prior to use in a print job.

BRIEF DESCRIPTION OF THE DRAWINGS

Preferred embodiments of the invention will now be described, by way of example, with reference to the accompanying drawings, in which.

DETAILED DESCRIPTION OF AN EMBODIMENT OF THE INVENTION

Figure 1:
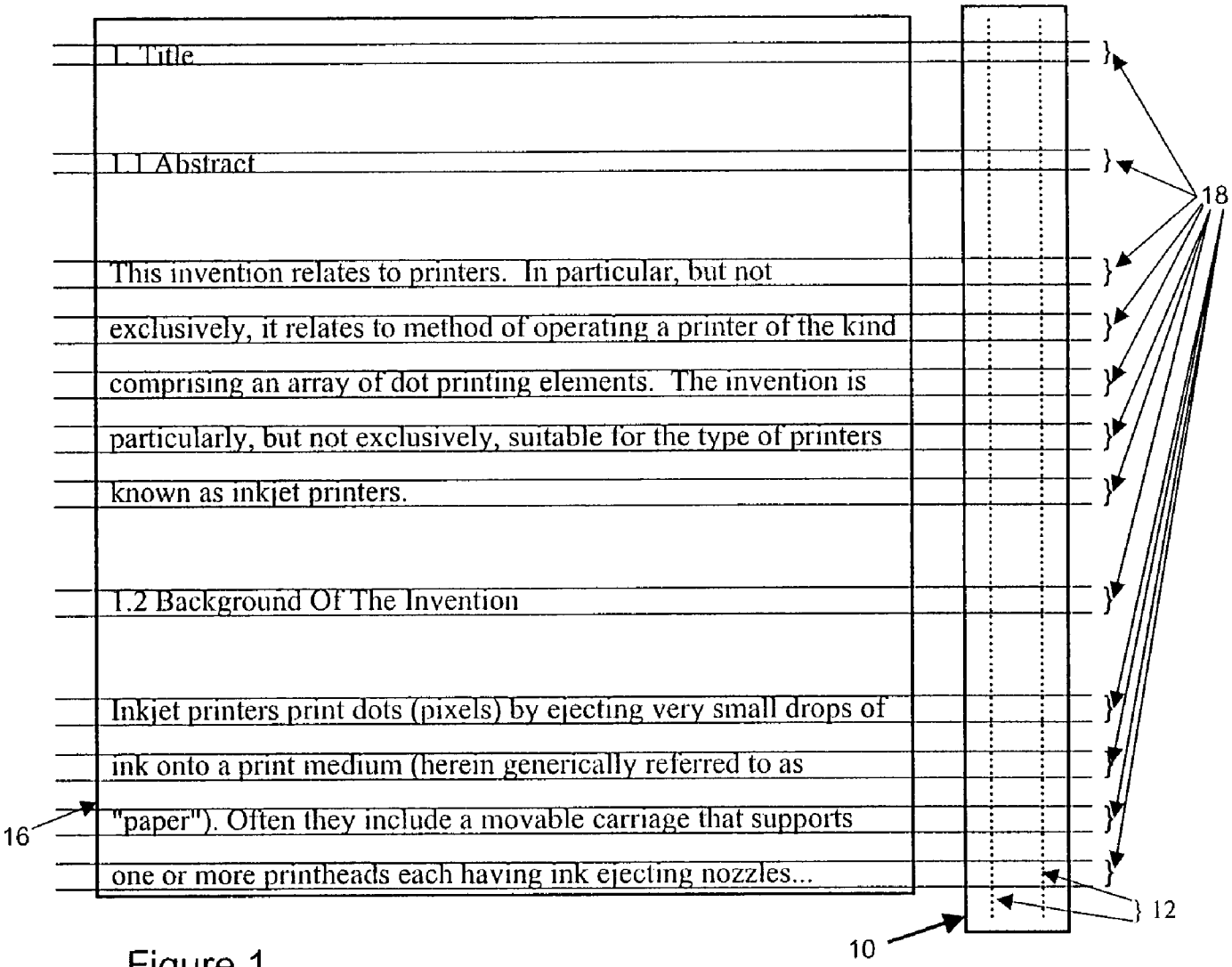
FIG. 1 illustrates (schematically) the operation of a page-high inkjet printer when printing a page of monochrome text according to one embodiment of the invention.

Referring to FIG. 1, a monochrome text printer comprises a printbar 10 having an array 12 of inkjet nozzles 14 (FIG. 2), the array extending along the printbar for substantially the full height of a page 16 of paper to be printed. In this embodiment the printbar 10 passes from right to left (as seen in FIG. 1) across the width of the page 16 and all the text is printed in a single pass of the printbar. In FIG. 1 the position of the printbar is shown after the page has been printed. To print a subsequent page the printbar is returned to the left hand side of the page. The mechanical construction of such printers, and the print control circuits which coordinate the movement of the printbar and/or paper with the timed firing of the nozzles, is well known to those skilled in the art.

As stated, in the prior art, before printing the page 16, assuming that it is the first page of a print job and that the printer has lain dormant for a substantial period beforehand, all the nozzles 14 are repeatedly fired to bring them into a serviceable condition with resultant wastage of ink. However, looking at FIG. 1, it will be immediately apparent that for the particular page 16 shown there, only certain portions of the nozzle array 12, i.e. those portions identified by the reference numeral 18, are used to print the lines of text. Therefore, in this embodiment, it is only necessary, prior to printing that page, to service nozzles within those portions 18, or at least to avoid servicing one or more, and preferably substantially all, the nozzles outside the portions 18. This provides a first level of ink saving.

While one could service all the nozzles in the array portions 18, a second level of ink saving is achieved by servicing less than all of the nozzles in the array portions 18. This is possible because there is substantial redundancy within the nozzles 14 in each array portion 18.

Figure 2:
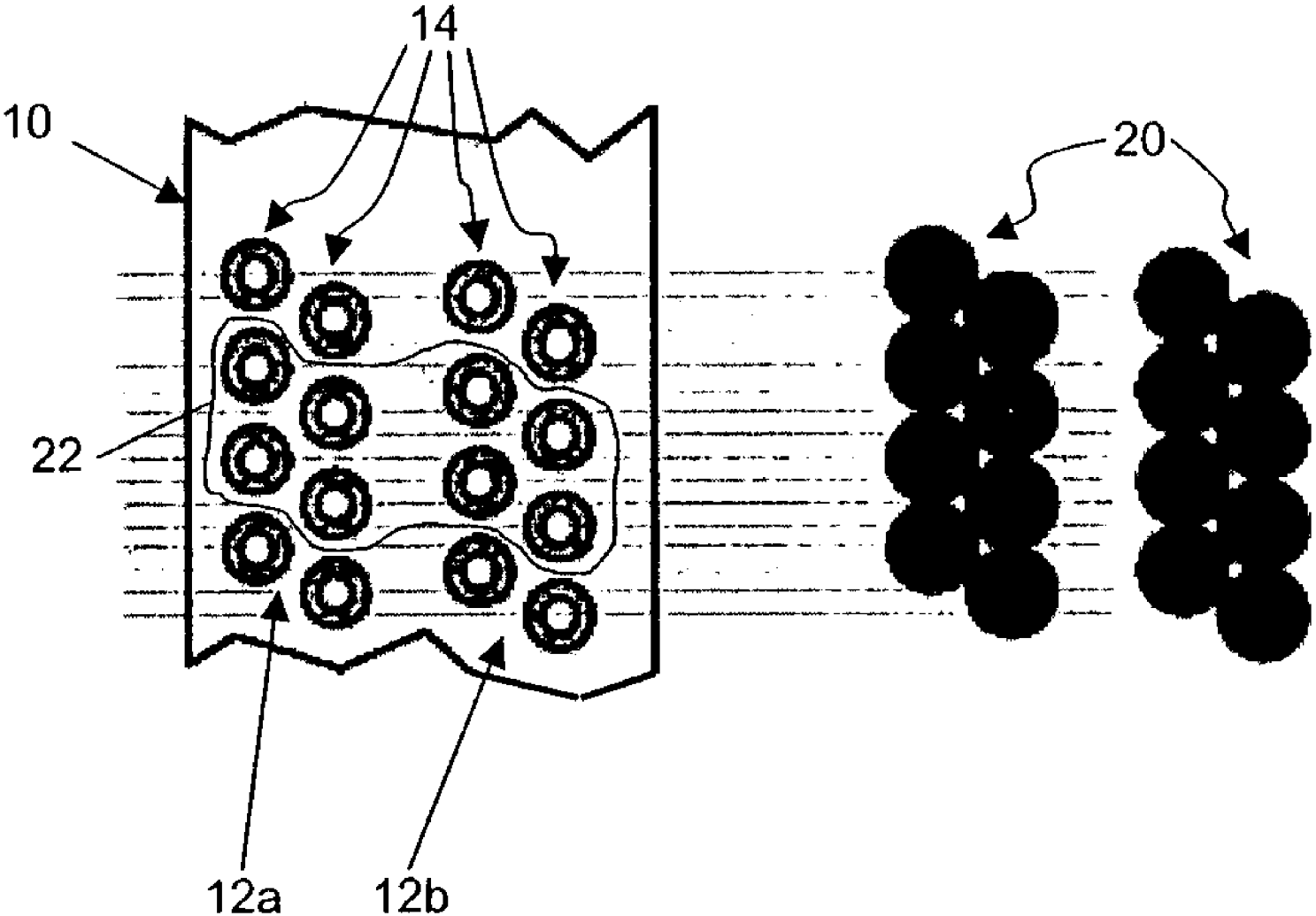
FIG. 2 is a close-up, diagrammatic view of part of the printbar of FIG. 1 illustrating redundant groups of inkjet nozzles.

Referring to FIG. 2, which shows a small part of the height of the printbar 10, the array 12 comprises two columns 12*a*, 12*b* of nozzles 14, the nozzles in each column being staggered along the print bar on $1/1200^{th}$ inch centres and the nozzles in column 12*b* being displaced by $1/2400^{th}$ of an inch relative to those in column 12*a*. Collectively, therefore, the nozzles 14 are spaced along the printbar on $1/2400^{th}$ inch centres; i.e. they have a 2400 dpi (dots per inch) nozzle pitch along the length of the printbar. The particular staggered arrangement of the nozzles 14, and their division into two columns, arises from the finite size of the nozzles (about 12 microns) and the manufacturing techniques used to make the printbar.

Now, it is rarely necessary to print at the full 2400 dpi resolution, and indeed this is generally not possible due to the relatively large size of the ink dots 20 produced by the nozzles, which typically have a diameter of more than 24 microns, which is equivalent to $1/1200^{th}$ inch resolution. Accordingly, the nozzles 14 are conventionally used in groups to print respective rows of halftone values at a selected resolution on the page. For example, for the printing of monochrome text, a resolution of 300 halftone rows per inch is generally quite satisfactory. It will be understood that a row of halftone values is a row of printing whose print density varies along the row according to the halftone values to be printed. Since each nozzle 14 can only print a dot of a single size, the halftone values are printed by firing different numbers of nozzles within a group for different halftone values.

For text printing at 300 halftone rows per inch, a group of four nozzles is sufficient to print the halftone row with each ink drop capable of covering an area having a diameter of approximately $1/1200^{th}$ of an inch. However, to avoid artefacts in the printed image, and thereby enhance image quality, it is well known to use a larger group of nozzles than the minimum necessary to print each halftone row and select different combinations of nozzles for the same halftone value at different positions along the row. This is known as redundancy. In the printer shown in FIGS. 1 and 2, for a resolution of 300 halftone rows per inch the array 12 would typically be grouped into groups of eight nozzles, such as the group 22, each for printing a respective halftone row.

While eight nozzles gives a good image quality, if one is prepared to accept slightly less, but still acceptable, image quality, one can use just six of the nozzles in each group 22. This gives less redundancy than the original eight nozzles in the group, but there is still some redundancy compared to the minimum number of four nozzles.

Accordingly, the second level of ink saving is achieved by servicing less than all of the nozzles in each group 22, while still leaving some redundancy, and only using the serviced nozzles to print the page. In the present embodiment it is assumed that six of a redundant group of eight nozzles are used in order to maintain acceptable image quality. However, in, for example, draft printmode, one could use only four, or even fewer, nozzles while still retaining redundancy within the group. It would even be possible to give-up redundancy completely, albeit only tolerable print quality might then be achieved.

Figure 3:
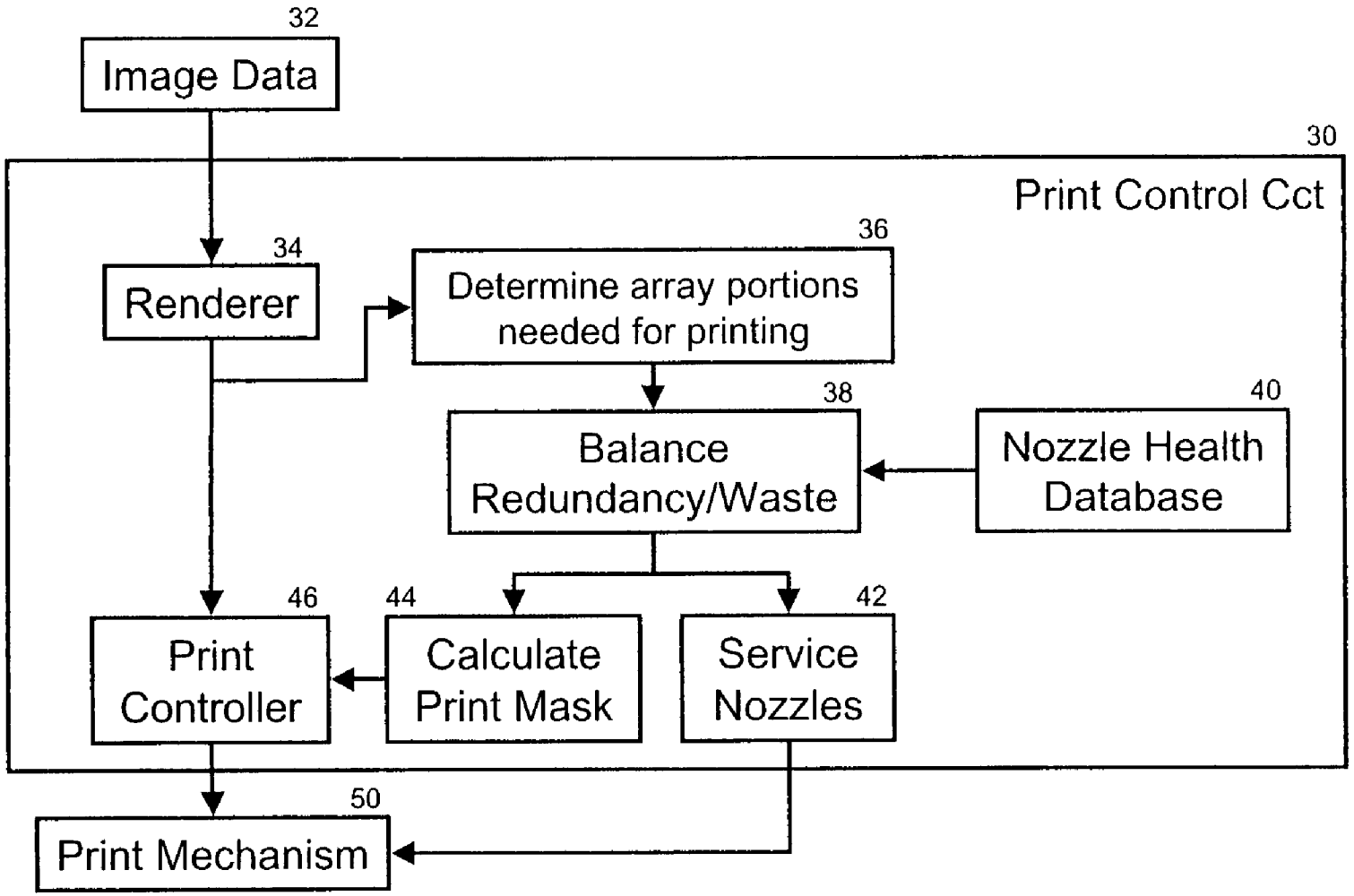
FIG. 3 is a block diagram of a print control circuit according to one embodiment of the invention.

FIG. 3 is a schematic block diagram of a print control circuit 30 for a page-high monochrome inkjet text printer which implements the ink saving techniques described above.

The circuit will be described in terms of the functions performed in printing the first page 16 of a print job. It will be understood, however, that although various functional blocks are shown as separate modules in FIG. 3, in practice these functions are implemented by a suitably programmed microprocessor and associated memory. The control circuit 30 controls and coordinates the operation of the mechanical and electrical components of the printer, that is to say, the paper feed mechanism, the printbar drive mechanism and the inkjet nozzle firing circuitry, all of which may be of conventional construction and are designated in FIG. 3 by the generic term "print mechanism" 50.

Image data 32 is received in a standard format such as Postscript, PCL, HPGL by the print control circuit 30 from a computer, scanner or other external device. The data is conventionally processed by a renderer 34 to convert the image data to rows of halftone data at a resolution less than that of the printbar nozzles. In this embodiment the renderer produces halftone rows at a resolution of 300 rows per inch, the nozzle resolution being 2400 to the inch.

Next, block 36, the circuit 30 determines the portions 18 of the nozzle array 12 which will be needed for printing the page 16. This is done by examining the print density along each row of the halftone data to determine halftone rows which are not blank along their full length.

Next, block 38, a decision is made as to what extent the redundancy in each group 22, within the needed array portions 18, can be reduced without an unacceptable reduction in image quality (IQ). In this embodiment it is assumed that a reduction of redundancy from 8 to 6 nozzles per redundant group 22 is acceptable. The particular 6 nozzles chosen can be any 6, and may vary from group to group, except when a nozzle health database 40 identifies certain nozzles as faulty in which case those nozzles are excluded from the reduced redundancy group. The concept of a nozzle health database is well-known in the art and identifies nozzles that, despite servicing, misfire or do not fire. The database 40 is built up by scanning test patterns according to the principles described, for example, in our copending U.S. patent application Ser. No. 10/697,010. Although the latter relates to incremental printers, the same principles can be used for page-wide and page-high printers.

Now, block 42, the print control circuit 30 instructs the print mechanism 50 to service just that reduced number of nozzles 18 in each redundant group 22 in the array portions 18. This is done prior to the printing of the page 16, i.e. at this point the printbar 10 is off the page 16 and there is no relative movement between the two. It will be appreciated that this results in a considerable saving in ink as compared to the prior art where all the nozzles are serviced irrespective of their use or degree of redundancy.

Meanwhile, block 44, the print mask of the image to be printed on the page 16 is calculated. The concept of a print mask is well-known. It is an image-independent matrix which determines which inkjet nozzle should be used at each potential dot printing position on the page. It doesn't determine whether a dot is actually to be printed at any given position, merely the nozzle which will be used if a dot is to be printed.

Whether or not a dot is to be printed at any given printing position is determined by the halftone image data from the renderer 34, the image data being combined with the print mask in a print controller 46 which calculates the nozzle firing pattern for that image. Typically, the nozzle firing pattern is a binary pattern that determines exactly which inkjet nozzles are fired at which instants during relative movement of the printbar over the page 16. The print controller 46 also controls the print mechanism 50 to print the page according to the firing pattern thus calculated.

At this point a single page 16 has been printed. If the print job consists of just that single page, the print job is complete. However, if the print job consists of multiple pages, the above method is repeated for the second and subsequent pages, except that it is necessary at block 42 only to service nozzles 18 not previously serviced in that print job.

The above embodiment assumes that the printbar prints from left-to-right only, and that a full page is printed in a single pass of the printbar. However, the page could be printed bi-directionally, one half of the dots being printed during left-to-right movement of the print bar and the other half printed during right-to-left movement.

Furthermore, the printbar need not extend the full height of the page, so that several passes are necessary to print the full page. For example, in a half-height printbar two passes will be necessary to print the full height of the page. In that case the above method could be used to service only those nozzles needed in the first pass, and then those further nozzles necessary for the second pass could be identified and serviced before the second pass. Preferably, however, even in multi-pass printers, it is preferred to determine and service all the nozzles needed for a full page prior to starting the print job.

Although the benefits of the invention are most keenly felt in respect of text printers/copiers, where blank regions of the paper are almost always present and coincident from page to page due to the use of the same margins and line spacing, the invention is not limited thereto. It is also not limited to monochrome printers which use only a single colour (usually black) of ink. In the case of colour printers where separate nozzle arrays are used for different colours, the above method is applied to each array.

The invention is not limited to the embodiment described herein and may be modified or varied without departing from the scope of the invention.

The invention claimed is:

1. A method of operating a printer of a kind comprising a print head having an array of dot printing elements extending in a first direction relative to a page to be printed and which prints at least a part of the page during relative movement between the print head and page, which moves in a second direction at an angle to the first direction, the method comprising performing the following steps:

(A) prior to a print job:

(a) identifying portions of the array of printing elements which will be needed at least for a first pass of the print head relative to the first page of the print job each array portion comprising at least one group capable of printing a respective row of halftone values at a given resolution on the page with redundancy among the elements of the group, and (b) servicing printing elements of the array portions identified in step (a), the servicing comprising:

(b1) for at least some groups, reducing the number of elements in the group available fo use, and (b2) servicing only the printing elements reamining avaiable for use after step (b1), and (B) printing the at least first pass.

2. A method as claimed in claim 1, wherein substantially all the printing elements outside the identified array portions are not serviced.

3. The method claimed in claim 1, wherein reducing the number of elements in the group according to step (b1) retains redundancy within the group.

4. The method claimed in claim 3, wherein step (b1) excludes faulty printing elements from the group as identified by a faulty print head database.

5. The method claimed in claim 1, wherein the array of printing elements extends substantially fully across the page in the first direction.

6. The method claimed in claim 1, wherein the at least first pass is the only pass so that the first page is printed in a single pass.

7. The method claimed in claim 6, wherein the print job comprises lines of text extending across the page substantially parallel to the second direction.

8. The method claimed in claim 1, wherein the printer is an inkjet printer and the dot printing elements are inkjet nozzles.

9. A computer readable medium containing program instructions which, when executed by a suitable data processing device associated with suitable hardware are adapted to perform the method claimed in claim 1.

10. An incremental printer comprising an array of printing elements arranged to print different portions of an image, the printer being arranged, prior to printing an image, to identify portions of the array of printing elements which will be needed at least for a first pass of the printing elements relative to the image, each array portion comprising at least one group capable of printing a respective row of halftone values at a given resolution of the image with redundancy among the elements of the group, and to service printing elements of the array portions identified by, for at least some groups, reducing the number of elements in the group available for use, and by servicing only the printing elements remaining available for use after reduction.

11. An incremental printer according to claim 10, wherein the elements are each arranged to print image content disposed along a respective row or column of the image, those elements having a position in the printer corresponding to a row or column in the image which is to remain unprinted being excluded from the servicing routine.

12. An incremental printer according to claim 10, wherein the elements are arranged in redundant groups, the elements in a given group being arranged to print image content in a common range of image positions, the printer being further arranged to designate one or more, but less than all, of the elements in one or more of the groups as being available for printing the image and to service substantially only the designated elements of those groups prior to printing the image.

13. An incremental printer according to claim 12, wherein one or more of those groups in which elements are designated as being available for printing the image retains printing redundancy.

14. An incremental printer according to claim 12, wherein the printer is arranged to designate substantially only those elements which are not identified as faulty.

15. An incremental printer according to claim 10, wherein the printing elements are arranged in a page wide or page high array.

16. An incremental printer according to claim 10, wherein the printer is an inkjet printer and the dot printing elements are inkjet nozzles.

17. A printer control circuit adapted to control an array of printing elements, the elements arranged to print different portions of an image, the circuit being arranged to:

identify portions of the array of printing elements which will be needed at least for a first pass of the print head relative to the first page of the print job, each array portion comprising at least one group capable of printing a respective row of halftone values at a given resolution on the page with redundancy among the elements of the group, and service printing elements of the array portions identified by, for at least some groups, reducing the number of elements in the group available for use, and by servicing only the printing elements remaining available for use after the reduction.

* * * * *

UNITED STATES PATENT AND TRADEMARK OFFICE

CERTIFICATE OF CORRECTION

PATENT NO. : 7,036,897 B2
APPLICATION NO. : 10/697313
DATED : May 2, 2006
INVENTOR(S) : Gonzalo Gaston et al.

It is certified that error appears in the above-identified patent and that said Letters Patent is hereby corrected as shown below:

On the Title page, in field (73), in “Assignee”, in column 1, line 1, after “Packard” insert -- Development --.

In column 6, line 2, in Claim 1, delete “fo” and insert -- for --, therefor.

In column 6, line 3, in Claim 1, delete “reamining” and insert -- remaining --, therefor.

In column 6, line 4, in Claim 1, delete “avaiable” and insert -- available --, therefor.

Signed and Sealed this

Thirty-first Day of March, 2009

John Doll

JOHN DOLL
*Acting Director of the United States Patent and Trademark Office*